US005985820A

United States Patent [19]

Khan-Lodhi et al.

[11] Patent Number: 5,985,820

[45] **Date of Patent: *Nov. 16, 1999**

[54] FABRIC SOFTENING COMPOSITION

[75] Inventors: Abid Nadim Khan-Lodhi, Hoole; Christopher Whaley, Wirral, both of United Kingdom

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,517

[22] Filed: Dec. 18, 1996

[30] Foreign Application Priority Data

Dec. 21, 1995 [GB] United Kingdom ..... 9526182

[51] Int. Cl.[6] ..... C11D 3/00; C11D 3/37; D06M 15/19

[52] U.S. Cl. ..... 510/522; 510/515; 510/526; 510/527; 510/475

[58] Field of Search ..... 510/515, 521, 510/522, 526, 527, 475

[56] References Cited

FOREIGN PATENT DOCUMENTS

| | | |
|---|---|---|
| 0331237 | 9/1989 | European Pat. Off. . |
| 0507478 | 10/1992 | European Pat. Off. . |
| 63-223099 | 9/1988 | Japan . |
| 63-245497 | 10/1988 | Japan . |
| 88/04341 | 6/1988 | WIPO . |
| 89/08111 | 9/1989 | WIPO . |

OTHER PUBLICATIONS

International Search Report No. PCT/EP 96/04843 dated Apr. 11, 1997.

*Primary Examiner*—Anthony Green
*Attorney, Agent, or Firm*—Neil Y. Gilbert, Esq.

[57] ABSTRACT

A fabric conditioning composition comprising;

i) a quaternary ammonium fabric softening compound containing at least one ester group and;

ii) a polymeric nonionic surfactant with a molecular weight of less than 15,000 and having two long chain alkyl groups in which the two long chains are separated from each other by a hydrophilic moiety.

9 Claims, No Drawings

FABRIC SOFTENING COMPOSITION

TECHNICAL FIELD

The present invention relates to fabric softening compositions, in particular the invention relates to aqueous dispersions of biodegradable fabric softening compositions the viscosity of which can be controlled.

BACKGROUND OF INVENTION

Rinse added fabric softener compositions are well known, however one of the problems associated with fabric softening compositions is that the viscosities of the formulations are difficult to control.

EP 0 358 749 (Unilever) discloses an aqueous fabric conditioning composition comprising a cationic fabric softener and a polymeric thickening materials such as nonionic polymers based on polyoxyalkylene or polvinylalcohol hydrophilic backbones to which a small number of alkyl groups have been attached. The application teaches that it is preferred if the polymeric thickening materials have a high molecular weight.

Hydrophobically modified nonionic cellulose ethers are used to thicken aqueous fabric softening compositions in EP 0 331 237 (Unilever).

We have found that it is possible to control the viscosity of a fabric conditioning composition with a greater degree of control than previously thought possible. We have also found that by including certain polymers, rinse conditioners can be prepared using conventional processes without needing a separate processing step for the addition of the viscosity control agent.

DEFINITION OF THE INVENTION

Accordingly the present invention provides a fabric conditioning composition comprising (i) a quaternary ammonium fabric softening compound containing at least one ester group and a polymeric nonionic surfactant (ii) with a molecular weight less than 15,000 and having two long chain alkyl groups in which the two long chains are separated from each other by a hydrophilic moiety.

The present invention also claims a method of thickening a fabric conditioning composition comprising a quaternary ammonium fabric softening compound (i)containing at least one ester group by the use of a polymeric nonionic surfactant (ii) having two long chain alkyl groups in which the two long chains are separated from each other by a hydrophilic moiety.

A process for preparing a rinse conditioner as described above is claimed, the process comprises the steps of i) melting the quaternary ammonium fabric softening compound and the polymeric nonionic surfactant to form a co-melt; ii) adding the resulting co-melt to water; iii) mixing at high shear.

DETAILED DESCRIPTION OF THE INVENTION

The polymeric nonionic surfactant (ii)

The polymeric nonionic surfactant present in the invention can control the viscosity of the fabric conditioning composition. The molecular weight of the polymeric nonionic surfactant is below 15,000, preferably below 10,000 most preferably below 7,000.

It is preferred if each of the alkyl chains of the polymeric nonionic surfactant (ii) are linked to the hydrophilic moiety by an ester, ether, carbonate, carbamate/urethane, carbamides, amides or amine groups; The two linking groups may be the same or different although it is preferred if the two linking groups are the same. It is particularly preferred if both linking groups are ether groups; it is especially preferred if both linking groups are ester groups.

Preferred polymeric nonionic surfactants are defined by formula I;

$$R^1—X—[PEO/PPO]—Y—R^2 \quad (I)$$

in which $R^1$ and $R^2$, which may be the same or different, are independently selected from $C_{10}$–$C_{22}$ alkyl or alkenyl chains; PEO/PPO is poly(ethylene oxide) or a copolymer of poly(ethylene oxide) and poly(propylene oxide), such that the polymer has a molecular weight below 15,000; and X and Y, which may be the same or different, are selected independently from the following linking groups: ether, ester, amine, amide, carbonate, carbamate/urethane, carbamide.

It is preferred if X and Y are independently selected linking groups such that:

for an ether linkage, X is O and/or Y is absent;

for an ester linkage, X is COO and/or Y is CO;

for an amine linkage, X is $N(R^3)$ and/or Y is $CH_2CH_2N(R^3)$;

for an amide linkage, X is $CON(R^3)$ and/or Y is $CH_2CH_2N(R^3)CO$;

for a carbonate, x is O—COO and/or Y is CC.O;

for a carbamate/urethane, X is $O—CON(R^3)$ or $CH_2CH_2N(R^3)—COO$ and/or Y is $CON(R^3)$ or $CH_2CH_2N(R^3)—COO$ and for a carbamide, X is $N(R^3)—CON(R^3)—$ and/or Y is $CH_2CH_2N(R^3)—CON(R^3)$ wherein $R^3$ is a $C_1$-$C_4$ alkyl group or hydroxyalkyl group or an hydrogen atom.

It is especially preferred if the polymeric material has the structure defined in formula II.

$$R^1COO—(CH_2CH_2O)_n—COR^2 \quad (II)$$

in which $R^1$, $R^2$ are as defined above and n is any number from 10 to 320, more preferably from 20 to 200, most preferably from 20 to 150.

Examples of suitable polymeric, nonionic surfactants include dilauryl PEG2000 (polyethlene glycol of molecular weight 2000); dilauroyl PEG2000 (alternatively known as PEG2000 dilaurate); lauryl PEG2000 laurate; N(lauryl PEG2000 ethyl)laurylamine: $C_{12}H_{25}O(CH_2CH_2O)_nCH_2CH_2—NHC_{12}H_{25}$; N(lauroyl PEG2000 ethyl) laurylamine: $C_{11}H_{23}COO(CH_2CH_2)_nCH_2CH_2—NHC_{12}H_{25}$; N(lauryl PEG 2000 ethyl)lauramide: $C_{12}H_{25}O(CH_2CH_2O)_nCH_2CH_2—NHCOC_{11}H_{23}$; N((lauroyl PEG 2000 ethyl) lauramide: $C_{11}H_{23}COO(CH_2CH_2O)_nCH_2CH_2—NHCOC_{11}H_{23}$.

The above polymeric, nonionic surfactants may be used with alternative hydrophobe chain lengths, in particular $C_{14}$, $C_{16}$, and $C_{18}$, and also alternative hydrophile chain lengths, in particular PEG1500, PEG4000, and PEG6000 (i.e. polyethylene glycol of molecular weight 1500, 4000, or 6000 respectively).

The Fabric Softening Compound

The fabric softening compound comprises a quaternary ammonium fabric softening compound containing at least one ester group.

Preferably the fabric softening compound of the invention has two long chain alkyl or alkenyl chains with an average chain length greater than $C_{14}$. More preferably each chain has an average chain length greater than $C_{16}$, and more preferably at least 50% of each long chain alkyl or alkenyl group has a chain length of $C_{18}$.

It is preferred if the long chain alkyl or alkenyl groups of the fabric softening compound are predominantly linear.

The fabric softening compositions of the invention are preferably compounds molecules which provide excellent softening, characterised by chain melting -Lβ to Lα-transition temperature greater than 25° C., preferably greater than 35° C., most preferably greater than 40° C. This Lβ to Lα transition can be measured by DSC as defined in "Handbook of Lipid Bilayers, D Marsh, CRC Press, Boca Raton Fla., 1990 (Pages 137 and 337).

It is advantageous if the fabric softening compound is substantially water insoluble. Substantially water-insoluble fabric softening compounds in the context of this invention are defined as fabric softening compounds having a solubility less than $1\times10^{-3}$ wt % in demineralised water at 20° C. Preferably the fabric softening compounds have a solubility less than $1\times10^{-4}$ *wt %*, most preferably the fabric softening compounds have a solubility of from $1\times10^{-8}$ to $1\times10^{-6}$.

It is more preferred if the quaternary ammonium material has two ester links present. A preferred ester-linked quaternary ammonium material for use in the invention can be represented by formula (III):

(III)

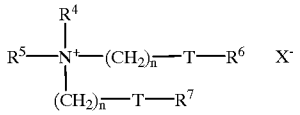

wherein $R^4$ and $R^5$, which may be the same or different, are independently selected from $C_{1-4}$ alkyl, hydroxyalkyl or $C_{2-4}$ alkenyl groups; $X^-$ is a suitable anion and wherein $R^6$ and $R^7$, which may be the same or different, are selected from $C_{8-28}$ alkyl or alkenyl groups;

T is

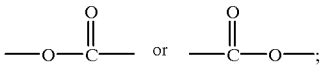

and n is an integer from 1–5.

A preferred material of this class is N-N-di(tallowoyloxy-ethyl) N,N-dimethyl ammonium chloride.

A second preferred type of quaternary ammonium material can be represented by the formula IV:

(IV)

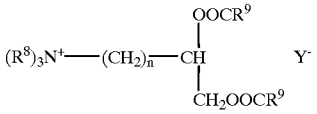

wherein each $R^8$, which may be the same or different, is independently selected from $C_{1-4}$ alkyl, alkenyl or hydroxyalkyl groups; each $R^9$, which may be same or different, is independently selected from $C_{8-28}$ alkyl or alkenyl groups; n is an integer from 0–5; and $Y^-$ is an anion.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180, for example, 1-hardened tallowoyloxy-2-hydroxy trimethylammonium propane chloride.

It is advantageous for environmental reasons if the quaternary ammonium material is biologically degradable.

The fabric softening compound of the composition may also be compound having the formula (V):

(V)

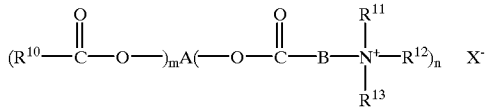

wherein X is an anion, A is an (m+n) valent radical remaining after the removal of (m+n) hydroxy groups from an aliphatic polyol having p hydroxy groups and an atomic ratio of carbon to oxygen in the range of 1.0 to 3.0 and up to 2 groups per hydroxy group selected from ethylene oxide and propylene oxide, m is 0 or an integer from 1 to p-n, n is an integer from 1 to p-m, and p is an integer of at least 2, B is an alkylene or alkylidene group containing 1 to 4 carbon atoms, $R^{10}$, $R^{11}$, $R^{12}$ and $R^{13}$ are, independently from each other, straight or branched chain $C_1$–$C_{48}$ alkyl or alkenyl groups, optionally with substitution by one or more functional groups and/or interruption by at most 10 ethylene oxide and/or propylene oxide groups, or by at most two functional groups selected from

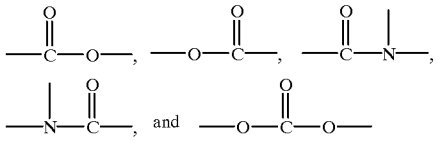

or $R^{11}$ and $R^{12}$ may form a ring system containing 5 or 6 atoms in the ring, with the proviso that the average compound either has at least one R group having 22–48 carbon atoms, or at least two R groups having 16–20 carbon atoms, or at least three R groups having 10–14 carbon atoms. Suitable materials of this type are disclosed in EP 638 639 (Akzo).

The level of cationic softening compound in the composition of the invention is preferably from 3 to 60 wt %, more preferably from 8 to 50 wt %, and most preferably from 8 to 30 wt %.

It is preferred if the ratio of cationic softening compound to polymeric nonionic surfactant is in the ratio from 300:1 to 1:1, preferably from 200:1 to 5:1.

The composition may also contain nonionic fabric softening agents such as lanolin and derivatives thereof.

Nonionic Surfactant

The viscosity can be modified further by the inclusion of a long chain nonionic surfactant.

If the detergent surfactant is a nonionic surfactant it may be characterised in terms of its phase behaviour. Suitable nonionic surfactants are those for which when contacted with water, the first lyotropic liquid crystalline phase formed is normal cubic (I1) or normal cubic-bicontinuous (V1) or hexagonal (H1) or nematic (Ne1), or intermediate (Int1) phase as defined in the article by G J T Tiddy et al, J Chem Soc. Faraday Trans. 1., 79, 975, 1983 and G J T Tiddy, "Modern Trends of Colloid Science in Chemistry and Biology", Ed. H-F Eicke, 1985 Birkhauser Verlag Basel]. Surfactants forming Lα phases at concentrations of less than 20 wt % are not suitable.

For the purposes of this invention nonionic surfactants may be defined as substances with molecular structures consisting of a hydrophilic and hydrophobic part. The hydrophobic part consists of a hydrocarbon and the hydrophilic part of a strongly polar group. The nonionic surfactants of this invention are soluble in water.

The most preferred nonionic surfactants are alkoxylated, preferably ethoxylated, compounds and carbohydrate compounds.

Examples of suitable ethoxylated surfactants include ethoxylated alcohols, ethoxylated alkyl phenols, ethoxylated fatty amides.and ethoxylated fatty esters.

Preferred nonionic ethoxylated surfactants have an HLB of from about 10 to about 20. It is advantageous if the surfactant alkyl group contains at least 12 carbon atoms.

Examples of suitable carbohydrate surfactants or other polyhydroxy surfactants include alkyl polyglycosides as disclosed in EP 199 765A (Henkel) and EP 238 638A (Henkel), poly hydroxy amides as disclosed in WO 93 18125A (Procter and Gamble) and WO 92/06161A (Procter and Gamble), fatty acid sugar esters (sucrose esters), sorbitan ester ethoxylates, and poly glycerol esters and alkyl lactobionamides.

Preferred nonionic surfactants are these having a long alkyl chain ($C_{12}$–$C_{22}$) and ethoxylated with 10 to 25 moles of ethylene oxide. Especially preferred nonionic surfactants include tallow alcohol ethoxylated with 15 or 20 moles of ethylene oxide and coco alcohol ethoxylated with 15 or 20 moles of ethylene oxide.

Preferred viscosities are achieved when the ratio of polymeric nonionic surfactant to long chain nonionic surfactant is from 10:1 to 1:50, more preferably 5:1 to 1:30, most preferably 3:1 to 1:3.

It is desirable if the viscosities of these fabric compositions lie in the range of from 1 mPa.s to 400 mPa.s at a shear rate of 110 $s^{-1}$, preferably in the range of from 5 to 250 mPa.s and most preferably from 10 to 150 mPa.s.

The formulation according to the invention may optionally contain amphoteric and other cationic surfactants Composition pH The compositions of the invention preferably have a pH from 1.5 to 5.

Other Inaredients

The composition may also contain long chain fatty acid material, for example, $C_8$–$C_{24}$ alkyl or alkenyl monocarboxylic acids or polymers thereof. Preferably saturated fatty acids are used, in particular hardened tallow $C_{16}$–$C_{18}$ fatty acids. Preferably the fatty acid is non-saponified, more preferably the fatty acid is free for example oleic acid. lauric acid or tallow fatty acid.

The level of fatty acid material is preferably at least 0.1%, more preferably at least 0.2% by weight. The weight ratio of quaternary ammonium compound to fatty acid material is preferably from 1:1 to 50:1.

The composition can also contain one or more optional ingredients, selected from non-aqueous solvents, pH buffering agents, perfumes, perfume carriers, fluorescers, colorants, hydrotropes, antifoaming agents, antiredeposition agents, polymeric thickeners enzymes, optical brightening agents, opacifiers, anti-shrinking agents, anti-wrinkle agents, anti-spotting agents, germicides, fungicides, antioxidants, anti-corrosion agents, drape imparting agents, antistatic agents and ironing aids.

The invention will now be illustrated by the following non-limiting examples. In the examples all percentages are expressed by weight.

Comparative Examples are designated by letters, while Examples of the invention are designated by numbers.

INGREDIENTS USED IN EXAMPLES

The abbreviations used in the Examples represent the following materials (* denotes a Trade Mark)

HT TMAPC: 1,2 bis[hardened tallowoyloxy]-3-trimethylammonium propane chloride DEEDMAC: N-N-di (tallowoyl-oxy-ethyl) N,N-dimethyl ammonium chloride.

Pristerine* 4916: fatty acid IPA: Isopropyl alcohol Coco 15 EO: coco alcohol ethoxylated with 15 ethoxy groups Coco 11 EO: coco alcohol ethoxylated with 11 ethoxy groups PEQ 5 (ex Akzo), 85% of formula V 15% IPA.

Preparation of Examples

Examples were prepared by adding a molten mixture of the ingredients to water at 70° C. and stirring the mixture to form a homogeneous mixture.

Softness Evaluation

Softening of the fabrics was assessed by an expert panel of 4 people using a round robin paired comparison test protocol. Each panel member assessed four sets of test cloths. Each set of test cloths contained one cloth of each test system under a evaluation. Panel members were asked to assess softness on a 8 point scale. Softness scores were calculated using an "Analysis of Variance" technique. Lower values are indicative of better softening.

Table 1 shows the effect of varying ratio of cationic compound (HT TMAPC): coco 15EO on viscosity.

TABLE 1

| Composition | Ex.A | Ex.B | Ex.C | Ex.D | Ex.E | Component | Ex.F | Ex.G | Ex.H | Ex.I | Ex.J |
|---|---|---|---|---|---|---|---|---|---|---|---|
| HT TMAPC | 0 | 2.53 | 5.05 | 7.58 | 10.11 | HEQ | 0 | 4.21 | 8.42 | 12.63 | 16.84 |
| Pristerine 4916 | 0 | 0.47 | 0.95 | 1.42 | 1.89 | Pristerine 4916 | 0 | 0.79 | 1.58 | 2.36 | 3.16 |
| IPA | 0 | 0.95 | 1.89 | 2.84 | 3.79 | Solvent | 0 | 1.58 | 3.16 | 4.74 | 6.32 |
| Coco 15 EO | 5 | 12 | 9 | 6 | 3 | Coco 15 EC | 25 | 20 | 15 | 10 | 5 |
| Water | 85 | 85 | 85 | 85 | 85 | Water | 75 | 75 | 75 | 75 | 75 |
| Perfume | 0.9 | 0.9 | 0.9 | 0.9 | 0.9 | Perfume | 0.9 | 0.9 | 0.9 | 0.9 | 0.9 |
| Viscosity measured (measured by capillary viscometer)/mpas | | | | | | | | | | | |
| | 4.53 | 5 | 5 | 5 | 15 | | 32 | 21 | 22 | 42 | 164 |

Table 2 demonstrates the viscosity of a fabric softening composition in the absence of nonionic.

TABLE 2

| | Example K | Example L | Example M | Example N | Example O |
|---|---|---|---|---|---|
| Component | | | | | |
| HEQ | 0.84 | 1.68 | 2.53 | 3.37 | 4.21 |
| Pristerine 4916 | 0.16 | 0.32 | 0.47 | 0.63 | 0.79 |
| Solvent | 0.32 | 0.63 | 0.95 | 1.26 | 1.58 |
| Water | 99 | 98 | 97 | 96 | 95 |
| Perfume | 0.9 | 0.9 | 0.9 | 0.9 | 0.9 |
| Shear Rate | Viscosity (measured by Haake rotoviscometer) /mPas | | | | |
| 110 $s^{-1}$ | 13.29 | 31 | 57 | 132 | 187 |

In the absence of nonionic the viscosities are very high, even at relatively low concentrations.

The effect of varying HT TMAPC with regard to PEG 2000 dilaurate is shown by table 3.

TABLE 3

| | Example 1 | Example 2 | Example 3 | Example 4 | Example 5 |
|---|---|---|---|---|---|
| Component | | | | | |
| HEQ | 10.11 | 7.58 | 5.05 | 2.52 | 0 |
| Pristerine 4916 | 1.89 | 1.42 | 0.95 | 0.47 | 0 |
| Solvent | 3.79 | 2.84 | 1.89 | 0.95 | 0 |
| PEG 2000 dilaurate | 3 | 6 | 9 | 12 | 15 |
| Water | 85 | 85 | 85 | 85 | 85 |
| Shear Rate | Viscosity (measured by Haake rotoviscometer) /mPas | | | | |
| @ 50$s^{-1}$ | 199 | 229 | 295 | 347 | 27 |
| @ 100$s^{-1}$ | 132 | 169 | 266 | 337 | 20 |
| @ 150$s^{-1}$ | 105 | 152 | 244 | 332 | 12 |

The effect of varying the PEG chainlength is demonstrated by Table 4.

TABLE 4

| | Example 6 | Example 7 | Example 8 |
|---|---|---|---|
| Component | | | |
| HEQ | 7.58 | 7.58 | 5.05 |
| Pristerine 4916 | 1.42 | 1.42 | 0.95 |
| Solvent | 2.84 | 2.84 | 1.89 |
| PEG 1500 dilaurate | 6 | | |
| PEG 2000 dilaurate | | 6 | |
| PEG 4000 dilaurate | | | 6 |
| Water | 85 | 85 | 85 |
| Perfume | 0.9 | 0.9 | 0.9 |
| Shear Rate | Viscosity (measured by Haake rotoviscometer)/mPas | | |
| @ 25$s^{-1}$ | 49 | 302 | 353 |
| @ 50$s^{-1}$ | 45 | 229 | 293 |
| @ 100$s^{-1}$ | 44 | 169 | 275 |
| @ 150$s^{-1}$ | 42 | 152 | 249 |

Table 5 shows that increasing level PEG chainlength increases the viscosity.

TABLE 5

| Component | Example 9 | Example 10 | Example 11 | Example 12 | Component | Example 13 | Example 14 | Example 15 | Example 16 | Example P |
|---|---|---|---|---|---|---|---|---|---|---|
| HEQ | 9 | 58 | 12.00 | 10.11 | HEQ | 7.58 | 7.58 | 7.58 | 7.58 | 7.58 |
| Pristerine 4916 | — | 1.42 | — | 1.89 | Pristerine 4916 | 1.42 | 1.42 | 1.42 | 1.42 | 1.42 |
| | | | | | Solvent | 2.84 | 2.84 | 2.84 | 2.84 | 2.84 |
| PEQ 2000 dilaurate | 6 | 6 | 3 | 3 | PEG 2000 dilaurate | 6 | 3 | 3 | 1.5 | 0 |
| | | | | | Coco 11 EO | 0 | 3 | 3 | 4.5 | 6 |
| Water | 85 | 85 | 85 | 85 | Water | 85 | 85 | 85 | 85 | 85 |
| | | | | | Perfume | 0.9 | 0.9 | 0.9 | 0.9 | 0.9 |
| Shear Rate | Viscosity (measured by Haake rotoviscometer)/mPas | | | | | | | | | |
| @ 25 $s^{-1}$ | 456 | 352 | 139 | 319 | @ 25 $s^{-1}$ | 257 | 181 | 80 | 24 | *5 |
| @ 50 $s^{-1}$ | 290 | 229 | 103 | 199 | @ 50 $s^{-1}$ | 218 | 149 | 78 | 16 | |
| @ 100 $s^{-1}$ | 263 | 169 | 86 | 131 | @ 100 $s^{-1}$ | 194 | 132 | 67 | 17 | |
| @ 150 $s^{-1}$ | 280 | 152 | 87 | | @ 150 $s^{-1}$ | 182 | 126 | 64 | 18 | |

*Measured by capillary viscometer.

TABLE 6

| | Example 17 | Example 18 | Example 19 | Example 20 | Example Q |
|---|---|---|---|---|---|
| Component | | | | | |
| HEQ | 9.94 | 9.94 | 9.94 | 9.94 | 9.94 |
| Pristerine 4916 | 0.56 | 0.56 | 0.56 | 0.56 | 0.56 |
| Propylene Glycol | 1.10 | 1.10 | 1.10 | 1.10 | 1.10 |
| PEG 2000 dilaurate | 4.5 | 3.375 | 2.25 | 1.125 | 0 |
| Coco 11 EO | 0 | 1.125 | 2.25 | 3.375 | 4.5 |
| Water | 85 | 85 | 85 | 85 | 85 |
| Perfume | 0.9 | 0.9 | 0.9 | 0.9 | 0.9 |
| Shear Rate | Viscosity (measured by Haake rotoviscometer) /mPas | | | | |
| @ $110s^{-1}$ | 203 | 98 | 77 | 18 | 8 |

TABLE 7

| | Example 21 | Example 22 | Example 23 | Example 24 | Example R |
|---|---|---|---|---|---|
| Component | | | | | |
| DEEDMAC | 10.26 | 10.26 | 10.26 | 10.26 | 10.26 |
| Pristerine 4916 | 0.24 | 0.24 | 0.24 | 0.24 | 0.24 |
| IPA | 1.57 | 1.57 | 1.57 | 1.57 | 1.57 |
| PEG 2000 dilaurate | 4.5 | 3.375 | 2.25 | 1.125 | 0 |
| Coco 11 EO | 0 | 1.125 | 2.25 | 3.375 | 4.5 |
| Water | 85 | 85 | 85 | 85 | 85 |
| Perfume | 0.9 | 0.9 | 0.9 | 0.9 | 0.9 |
| Shear Rate | Viscosity (measured by Haake rotoviscometer) /mPas | | | | |
| @ $110s^{-1}$ | 170 | 83 | 67 | 38 | 22 |

TABLE 8

| | Example 25 | Example 26 | Example 27 | Example 28 | Example S |
|---|---|---|---|---|---|
| Component | | | | | |
| DEEDMAC | 8.80 | 8.80 | 8.80 | 8.80 | 8.80 |
| Pristerine 4916 | 0.21 | 0.21 | 0.21 | 0.21 | 0.21 |
| IPA | 1.35 | 1.35 | 1.35 | 1.35 | 1.35 |
| PEG 2000 dilaurate | 6 | 4.5 | 3 | 1.5 | 0 |
| Coco 11 EO | 0 | 1.5 | 3 | 4.5 | 6 |
| Water | 85 | 85 | 85 | 85 | 85 |
| Perfume | 0.9 | 0.9 | 0.9 | 0.9 | 0.9 |
| Shear Rate | Viscosity (measured by Haake rotoviscometer) /mPas | | | | |
| @ $110s^{-1}$ | 221 | 180 | 96 | 32 | 8 |

TABLE 9

| | Example 29 | Example 30 | Example 31 | Example 32 | Example T |
|---|---|---|---|---|---|
| Component | | | | | |
| HEQ | 8.84 | 8.84 | 8.84 | 8.84 | 8.84 |
| Pristerine 4916 | 1.66 | 1.66 | 1.66 | 1.66 | 1.66 |

TABLE 9-continued

| | Example 29 | Example 30 | Example 31 | Example 32 | Example T |
|---|---|---|---|---|---|
| Solvent | 3.32 | 3.32 | 3.32 | 3.32 | 3.32 |
| PEG 2000 dilaurate | 4.5 | 3.375 | 2.25 | 1.125 | 0 |
| Tallow 15 EO | 0 | 1.125 | 2.25 | 3.375 | 4.5 |
| Water | 85 | 85 | 85 | 85 | 85 |
| Perfume | 0.9 | 0.9 | 0.9 | 0.9 | 0.9 |
| Shear Rate | Viscosity (measured by Haake rotoviscometer) /mPas | | | | |
| @ $110s^{-1}$ | 101 | 86 | 53 | 48 | 33 |

Softening Results

| | Example 1 | Example 2 | Example 3 |
|---|---|---|---|
| Softness Score | 3.7 | 4.2 | 3.5 |

| | Example 13 | Example 14 | Example 15 | Example 16 | Example P |
|---|---|---|---|---|---|
| Softness Score | 4.4 | 4 | 3.3 | 4.5 | 4.5 |

Compositions—Given as parts by weight

TABLE 10

| | Example U | Example 33 | Example 34 | Example 35 |
|---|---|---|---|---|
| PEQ 5 3 | 15 | 12 | 13.5 | 13.5 |
| PEG 4000 dilaurate | — | — | — | 1.5 |
| PEG 2000 dilaurate | | 3 | 1.5 | — |
| IPA | 2.65 | 2.12 | 2.38 | 2.38 |
| Perfume | 0.9 | 0.9 | 0.9 | 0.9 |
| Water | 85 | 85 | 85 | 85 |
| Shear rate - Viscosity (measured by Haake rotoviscometer) | | | | |
| 100 s-1 | 5 | 177 | 46 | 55 |
| Stored for 8 weeks | | | | |
| 4° C. | stable | stable | stable | stable |
| 20° C. | phase sep. | stable | stable | stable |
| 37° C. | phase sep. | stable | stable | stable |

3—PEQ 5 is prepared according to EP 638 639 (Akzo) from pentaerythritol—fatty acid—chloroacetic acid at a ratio of 1:2:1.7 respectively followed by reaction with trimethylamine.

TABLE 11

| | Example Q | Example 36 | Example 37 | Example 38 |
|---|---|---|---|---|
| HEQ | 11.53 | 11.53 | 11.53 | 11.53 |
| Pristerine 4916 | 1.97 | 1.97 | 1.97 | 1.97 |
| PEG 6000 dilaurate | — | 0.125 | 0.25 | 0.5 |
| Coco 20EO | 3 | 2.875 | 2.75 | 2.5 |
| Solvent | 3.59 | 3.59 | 3.59 | 3.59 |
| Perfume | 0.9 | 0.9 | 0.9 | 0.9 |
| Water | 80 | 80 | 80 | 80 |

TABLE 11-continued

| | Example Q | Example 36 | Example 37 | Example 38 |
|---|---|---|---|---|
| Shear rate - Viscosity (measured by Haake rotoviscometer)/mPAS | | | | |
| 100 s-1 | 30 | 55 | 85 | 178 |

We claim:

1. A fabric conditioning composition comprising;

(i) a quaternary ammonium fabric softening compound containing at least one ester group and;

(ii) a polymeric nonionic surfactant with a molecular weight less than 15,000 and having two alkyl groups separated from each other by a hydrophilic moiety, wherein each of the alkyl groups are independently selected from $C_{10}$–$C_{22}$ alkyl or alkenyl chains and the ratio of (i) to (ii) is from about 300:1 to 1:5.

2. A fabric conditioning composition according to claim 1 in which the alkyl chains of the polymeric nonionic surfactant (ii) are each linked to the hydrophilic moiety by a linking group selected from an ester group, an ether group, an amide group, an amine group, a carbonate group or a carbamatelurethane group or a carbamide group, wherein the linking group may be the same or different.

3. A fabric conditioning composition according to claim 1 in which both the alkyl groups of the polymeric nonionic surfactant (ii) are linked to the hydrophilic moiety by an ester group.

4. A fabric conditioning composition according to claim 1 in which the polymeric nonionic surfactant (ii) is:

$$R_1—X—[Q]Y—R_2$$

in which $R_1$ and $R_2$, which may be the same or different, are independently selected from $C_{10}$–$C_{22}$ alkyl or alkenyl chains; Q is poly (ethylene oxide) or a copolymer of poly (ethylene oxide) and poly (propylene oxide), such that the polymer has a molecular weight below 15,000; and X and Y, which may be the same or different, are selected independently from the following groups: ether, ester, amine, amide, carbonate, carbamate/urethane, or carbamide.

5. A fabric conditioning composition according to claim 1 in which the polymeric nonionic surfactant (ii) is:

$$R_1COO—(CH_2CH_2O)_n—COR_2$$

in which $R_1$ and $R_2$, which may be the same or different, are independently selected from C10–C22 alky or alkenyl chains and n is any number between 20 and 200.

6. A fabric conditioning composition according to claim 1 which further comprises a nonionic surfactant ethyoxylated with 10 to 25 moles of ethylene oxide.

7. A fabric conditioning composition according to claim 6 in which the ratio of polymeric nonionic surfactant to nonionic surfactant is from 3:1 to 1:3.

8. A fabric conditioning composition according to claim 1 in which the quatemary ammonium fabric softening compound (i) is selected from the group consisting of:

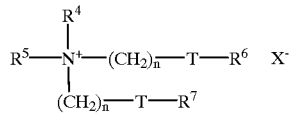

wherein $R^4$ and $R^5$, which may be the same or different, are independently selected from $C_{1-4}$ alkyl, hydroxyalkyl or $C_{2-4}$ alkenyl groups; $X^-$ is an anion and wherein $R^6$ and $R^7$, which may be the same or different, are selected from $C_{8-28}$ alkyl or alkenyl, groups; T is —OCO -or —COO; and n is an integer from 1–5; and

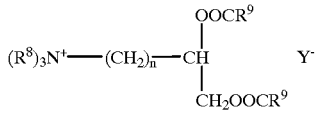

wherein each $R^8$, which may be the same or different, is independently selected from $C_{1-4}$ alkyl, alkenyl or hydroxyalkyl groups; each $R^9$, which may be same or different, is independently selected from $C_{8-28}$ alkyl or alkenyl groups; n is an integer from 0–5; and $Y^-$ is an anion.

9. A method of thickening a fabric conditioning composition comprising: providing a quaternary ammonium fabric softening compound containing at least one ester group; providing a polymeric nonionic surfactant having two alkyl groups separated from each other by a hydrophilic moiety, wherein each of the two alkyl groups are independently selected from $C_{10}$–$C_{22}$ alkyl or alkenyl chains; and thickening said quartemary ammonium fabric softening compound by incorporating said polymeric nonionic surfactant.

* * * * *